US012042852B2

(12) United States Patent
Platzer et al.

(10) Patent No.: US 12,042,852 B2
(45) Date of Patent: Jul. 23, 2024

(54) APPARATUS FOR CREATING AT LEAST ONE METAL COMPONENT AND METHOD THEREFOR

(71) Applicants: Dynamic Metal Systems R & D GmbH, Graz (AT); The Japan Steel Works, LTD., Tokyo (JP)

(72) Inventors: Christian Platzer, Graz (AT); Lukas Simonitsch, Wolfsberg (AT); Alexander Platzer, Graz (AT)

(73) Assignees: DYNAMIC METAL SYSTEMS R & D GMBH, Graz (AT); THE JAPAN STEEL WORKS, LTD., Tokyo (JP)

( * ) Notice: Subject to any disclaimer, the term of this patent is extended or adjusted under 35 U.S.C. 154(b) by 0 days.

(21) Appl. No.: 18/022,641

(22) PCT Filed: Jul. 5, 2021

(86) PCT No.: PCT/AT2021/060235

§ 371 (c)(1),
(2) Date: Feb. 22, 2023

(87) PCT Pub. No.: WO2022/040707

PCT Pub. Date: Mar. 3, 2022

(65) Prior Publication Data

US 2023/0311200 A1 Oct. 5, 2023

(30) Foreign Application Priority Data

Aug. 31, 2020 (AT) ..... A 50731/2020

(51) Int. Cl.
*B22D 17/20* (2006.01)
*B22D 17/22* (2006.01)

(52) U.S. Cl.
CPC ..... *B22D 17/2023* (2013.01); *B22D 17/2038* (2013.01); *B22D 17/2272* (2013.01)

(58) Field of Classification Search
CPC ..... B22D 17/007; B22D 17/2015; B22D 17/2023; B22D 17/2272
See application file for complete search history.

(56) References Cited

U.S. PATENT DOCUMENTS

2004/0151799 A1 8/2004 Gellert et al.
2007/0199673 A1 8/2007 Manda
(Continued)

FOREIGN PATENT DOCUMENTS

DE 103 59 692 A1 7/2004
DE 10 2008 022 109 A1 11/2008
(Continued)

OTHER PUBLICATIONS

International Search Report issued in International Patent Application No. PCT/AT2021/060235, dated Aug. 23, 2021, along with an English translation thereof.
(Continued)

*Primary Examiner* — Kevin E Yoon
(74) *Attorney, Agent, or Firm* — GREENBLUM & BERNSTEIN, P.L.C.

(57) ABSTRACT

Method and apparatus for creating at least one metal component by injecting flowable metal casting material into at least one cavity of a multi-part casting mold. Arranged successively downstream, apparatus includes a conveyor device for the flowable metal material, a distributor unit and the mold. The distributor unit includes an inlet channel connected to the conveyor device, and multiple outlet channels each having an outlet nozzle, such that casting material fed under pressure via the distributor inlet channel is injectable via the outlet nozzles into the at least one cavity of the mold to simultaneously fill the at least one cavity with casting material via the outlet nozzles. To produce the component with high process reliability in high quality, at least one of the outlet channels is connected to the mold in
(Continued)

a sliding manner to enable relative movement between the outlet nozzle of the outlet channel and the mold.

21 Claims, 3 Drawing Sheets

(56) References Cited

U.S. PATENT DOCUMENTS

| | | | | |
|---|---|---|---|---|
| 2007/0221352 | A1 | 9/2007 | Manda | |
| 2008/0279978 | A1 | 11/2008 | Babin et al. | |
| 2008/0292746 | A1* | 11/2008 | Olaru ..... | B22D 17/2023 425/549 |
| 2010/0183762 | A1 | 7/2010 | Babin | |
| 2015/0375436 | A1 | 12/2015 | Spuller et al. | |

FOREIGN PATENT DOCUMENTS

| | | | |
|---|---|---|---|
| DE | 10 2008 017 931 | A1 | 10/2009 |
| DE | 20 2010 017 853 | U1 | 11/2012 |
| DE | 20 2016 004 378 | U1 | 11/2016 |
| DE | 11 2015 002 978 | T5 | 3/2017 |
| DE | 11 2015 002 979 | T5 | 6/2017 |
| WO | 2007/095719 | A1 | 8/2007 |
| WO | 2011/057943 | A1 | 5/2011 |

OTHER PUBLICATIONS

Written Opinion of the International Searching Authority issued in International Patent Application No. PCT/AT2021/060235, dated Aug. 23, 2021.

* cited by examiner

APPARATUS FOR CREATING AT LEAST ONE METAL COMPONENT AND METHOD THEREFOR

The invention relates to an apparatus for creating at least one metal component by injecting flowable, in particular thixotropic, metal casting material into at least: one cavity of a multi-part casting mold, comprising, arranged successively downstream, a conveyor device for the flowable metal material, a distributor unit, in particular embodied as a hot runner system, and the multi-part casting mold, wherein the distributor unit comprises an inlet channel, Which is connected to the conveyor device, and multiple outlet channels each having an outlet nozzle, such that casting material fed under pressure via the distributor inlet channel can be injected via the outlet nozzles into the at least one cavity of the casting mold in order to simultaneously fill the at least one cavity with casting material via the outlet nozzles.

The invention furthermore relates to a method for creating at least one metal component, wherein flowable metal casting material is guided, under pressure, from a conveyor device to a multi-part casting mold via a distributor unit to create the metal component, wherein the casting material is guided to multiple outlet channels of the distributor unit via at least one inlet channel of the distributor unit and is injected into at least one cavity of the casting mold via outlet nozzles of the outlet channels, in order to simultaneously fill the at least one cavity with casting material via the outlet nozzles, characterized in that at least one of the outlet channels is connected to the casting mold in a sliding manner in order to enable a relative movement between the outlet nozzle of the outlet channel and the casting mold.

From the prior art, apparatuses are known which are based on liquid metal being injected into a cavity of the casting mold and solidifying. In particular, die-casting apparatuses and die-casting methods, which enable cost-efficient production due to high process speeds and short cycle times, have proven effective.

As an additional practicable method, in particular for producing near-net-shape components, the thixomolding method or thixoforming method has also become known, in which a metal casting material, usually an Mg-based alloy, is normally brought into a thixotropic state in a temperature range between the solidus temperature and the liquidus temperature of the casting material, in particular with a shearing load on the casting material, and is, in this state, pressed into a cavity of a mold under pressure via a nozzle using a conveying device. In this manner, it is possible to produce components with high precision and quality. However, a preparation, supply, and pressing-into-a-mold of material in the thixotropic state normally requires a complex process management and longer cycle times.

In order to reduce a formation of casting defects during an injection of thixotropic casting material, it is known that the cavity can be filled simultaneously via multiple casting material feed channels which connect to the casting chamber at different positions of said chamber. For this purpose, a distributor unit having multiple outlet channels or runners is used, via which channels or runners casting material is simultaneously injected into the cavity using nozzles. An apportioning of the casting material, which is normally fed at high temperature and under high pressure, to multiple runners using the distributor unit occurs such that the distributor unit is heated up to a branching point at which the distributor unit brandies into the plurality of runners. Though a large number of gate positions are advantageous for a quick and homogeneous mold-filling and the fewest possible air inclusions, a cooling of the casting material must be expected on the way from the branching point of the distributor unit to the gate positions. The latter leads to a reduction in quality of the structure of molded parts and, possibly, to casting defects.

In order to eliminate this problem, it has also become known that the distributor unit can be heated beyond the branching point, and thus essentially up to the gate positions. In practice, however, it has been shown that, in the case of full-length heating of the distributor unit and/or a necessary fabrication from different materials, the runners can disadvantageously be deformed at an operating temperature of normally several hundred ° C., so that outlets of the distributor unit no longer bear against the gate positions in an exact manner, as a result of which difficulties arise during casting and, in particular, material cannot be reliably injected as desired.

This is addressed by the invention. The object of the invention is to specify an apparatus of the type named at the outset with which a metal component can be produced with high process reliability in high quality.

It is furthermore an object to specify a method of the type named at the outset with which a metal component can be produced in a low-wear and high-quality manner.

According to the invention, the object is attained with an apparatus of the type named at the outset if at least one of the outlet channels is connected to the casting mold in a sliding manner in order to enable a relative movement between the outlet nozzle of the outlet channel and the casting mold.

The basis of the invention is the idea of countering a thermal expansion associated with a heating of the distributor unit, in particular the outlet channels thereof, not with an altered process control, but rather with a constructive modification of the apparatus. In that at least one, in particular a plurality, of the outlet channels is connected to the casting mold in a sliding manner, typically by means of a slip joint, mechanical stresses generated by the thermal expansion of the distributor unit, in particular mechanical stresses that act on the outlet nozzle, can be reduced or eliminated. Thus, a mechanical loading in particular, specifically a deformation, of the outlet channels, in some cases up to the destruction thereof, and/or a skewing of the outlet nozzles can be avoided. Furthermore, in this manner a wear of the distributor unit can be reduced or a service life of the apparatus, in particular the distributor unit, can be increased, and an injection operation of the casting material into the cavity, mainly in the case of a cyclical repetition of a manufacturing process of components using the apparatus, is feasible with high and, in particular, consistent quality. As a result, a high process reliability for an injection of casting material into the cavity and the production of the component in high quality is enabled. This applies in particular where multiple, preferably all, of the outlet nozzles are so connected to the casting mold in a sliding manner, in particular with a slip joint of this type. The aforementioned effects can be achieved with particular efficiency if each of the outlet channels is connected to the casting mold in a sliding manner such that a respective relative movement between the outlet nozzles and the casting mold is enabled separately from one another.

It has been shown that the aforementioned effects can specifically also be achieved if a metal material in the thixotropic state is used as casting material and/or the distributor unit or the inlet channels and/or outlet channels thereof are embodied as a hot runner system. A high operational readiness of the apparatus and, in particular, a production of near-net-shape components with high precision are thus enabled.

For a high process reliability and component quality, it is beneficial if the outlet channel is connected to the casting mold or positioned thereon in a sliding manner so that the outlet nozzle of the outlet channel can be displaced transversely or angularly, in particular orthogonally, to an injection direction of the outlet nozzle relative to the casting mold. This enables an efficient compensation of thermal expansions occurring in the distributor unit, in particular the outlet channels. Typically, it is provided that at least one of the outlet channels is connected to the casting mold in a sliding manner, in particular by means of a slip joint, so that a relative movement between the outlet nozzle of said outlet channel and the casting mold is enabled to a limited extent in a direction transverse, in particular orthogonal, to the injection direction of the outlet nozzle, in order to enable a relative movement between the outlet nozzles caused by thermal expansion of the distributor unit.

It is advantageous if, when the distributor unit or the outlet channel is at casting temperature, an outlet opening of the outlet nozzle of the outlet channel and an injection opening of the casting mold are aligned to be essentially flush with one another by a sliding movement of the outlet nozzle relative to the casting mold, in order to inject casting material into the cavity through the outlet opening via the injection opening. Because the outlet nozzle is thusly aligned relative to the injection opening of the casting mold, a high precision can be achieved when filling the cavity. Typically, it is provided that the at least one outlet nozzle is aligned relative to an injection opening of the casting mold, via which injection opening casting material can be injected into the cavity of the casting mold using the outlet nozzle when the distributor unit is at casting temperature, such that, through a sliding movement of the outlet nozzle relative to the casting mold, an outlet opening of the outlet nozzle and the injection opening assume an essentially flush or centered alignment when the distributor unit or the outlet channel is at casting temperature. Normally, it is provided that the outlet opening of the outlet nozzle is non-flush with or off-center from the injection opening when the distributor unit or the outlet channel is at non-casting temperature, in particular room temperature, and is displaced into a flush or centered position by a sliding when the distributor unit or the outlet channel is at casting temperature, when casting material can be injected into the casting mold. As a result, the casting material can be injected into the cavity in a predefined manner using the outlet nozzle, in particular with precise angular alignment, whereby casting defects can be reduced or avoided. It shall be understood that non-casting temperature thereby typically refers to a temperature that is lower in comparison with the casting temperature, at which lower temperature no casting material is injected via the distributor unit or the outlet channel or said distributor unit is not filled with flowable casting material.

A robust connection can be achieved if the outlet channel and the casting mold are connected to one another in a sliding manner in a form fit, wherein a relative movement between the outlet nozzle of the outlet channel and the casting mold is enabled to a limited extent in a direction transverse to the injection direction of the outlet nozzle. A form fit is a connection through spatial embedding. It is expedient if the form fit or the form-fitting connection is embodied such that the relative motion between the outlet nozzle and casting mold is enabled to a limited extent in multiple directions, in particular in directions aligned orthogonally to one another, or along axes of this type. The directions or axes thereby typically lie on one plane, usually orthogonal to the injection direction of the respective nozzle. In this manner, the slip joint can be embodied in a simple and resilient manner with a form fit of this type between the outlet channel and the casting mold.

It is practical if the outlet channel has an outer diameter that varies along its longitudinal axis, in order to create the form fit between the outlet channel and the casting mold. Thus, a resilient form-fitting connection can easily be produced between the outlet channel and the casting mold.

For example, it can be provided that the casting mold comprises a connecting element or a receptacle which engages behind a region of the outlet channel or engages in a region of the outlet channel with a reduced outer diameter, and thus effects a form fit.

For a resilient connection, it is beneficial if the outlet channel comprises a form, in particular running along a circumference of the outlet channel, in order to create the form fit between the outlet channel and the casting mold. It can expediently be provided that the form is inserted into a receptacle of the casting mold in a form fit, and can be moved in a sliding manner therein. The connection is particularly robust if the form runs along the circumference of the outlet channel in a ring shape. Loads that act on the form, in particular tensile loads in an axial direction of the outlet channel or the outlet nozzle thereof, can thus be distributed uniformly to the circumference of the outlet channel. Alternatively, multiple forms can also be arranged along the circumference of the outlet channel in order to achieve the same effects. It shall be understood that, analogously, a form of this type can be arranged on the casting mold and a receptacle, for example, can be arranged on the outlet channel in order to realize a connection with a corresponding effect. Generally, a connection of this type with any desired concrete design is sufficient, provided that a spatial embedding of the form which permits a sliding according to the invention is carried out.

It is advantageous if the slip joint is produced when a, preferably flat, contact surface is arranged on an end piece of the outlet channel that comprises the outlet nozzle, which contact surface rests in a sliding manner on a resting surface of the casting mold that corresponds to the contact surface, in order to connect the outlet channel to the casting mold in a sliding manner. This enables a low-error embodiment of the slip joint. It is expedient if the outlet channel and the casting mold are connected such that casting material is sealed in, or if the slip joint is embodied such that casting material is sealed in. This can be realized in a particularly efficient manner with the aforementioned resting of the contact surface and resting surface on top of one another. It is often provided that a compression connection or friction connection is present between the contact surface and resting surface in order to achieve a leak tightness for the casting material, wherein a coefficient of static friction of the compression connection or friction connection is chosen in such a limited manner that a sliding between the contact surface and resting surface is enabled when thermal expansion of the distributor unit occurs. Alternatively or cumulatively, a seal element, in particular multiple seal elements, can be arranged between the contact surface and resting surface in order to achieve a leak tightness for the casting material. The seal element can be formed with metal material, for example copper, or ceramic material. The seal element is often embodied as a sealing ring. For a robust sliding, it is beneficial if an outlet nozzle opening of the outlet nozzle is bordered or surrounded by the contact surface. This applies in particular in a cross-section through the outlet nozzle. A directionally independent sliding in particular is thus easily realizable. For this purpose, it has proven effective if the outlet nozzle or the outlet nozzle opening opens into the contact surface.

A high practicability can be achieved if the end piece of the outlet channel is, in particular detachably, inserted into an end bushing, wherein the end bushing constitutes an enlargement of an outer diameter of the outlet, channel in order to connect the outlet channel to the casting mold in a sliding manner, in particular with the creation of the form fit. The form fit can thus be easily produced. It is practical if the end bushing forms the contact surface. The end bushing is typically embodied such that it envelops or grips in a circumferential manner the end piece of the outlet channel, at least in sections, preferably completely. It is additionally expedient if the end bushing in particular grips a side of the end piece facing the casting mold, so that the end bushing forms the contact surface in a state of the end piece in which it is connected to the casting mold. The end bushing can, for example, be embodied as a cup-like attachment that is fitted onto the outlet channel, wherein a base of the attachment comprises a passage corresponding to the outlet nozzle, through which passage casting material can be guided using the outlet nozzle. The outlet nozzle is usually at least partially, in particular completely, inserted into the passage or fed through the passage or opens into the passage. Preferably, a thermal expansion of the outlet nozzle in an injection direction, in particular relative to the end bushing, it thus enabled. Expediently, the end bushing can be connected to the outlet channel or the end piece in a form fit and/or force fit and/or materially bonded manner, or can be embodied as part of the outlet channel or end piece. For an easy serviceability, it is beneficial if the end hushing is detachably connected to the outlet channel or the end piece thereof. In particular, the end bushing can thus be easily serviced and/or replaced as a part that is liable to wear. Because the end bushing increases the outer diameter of the outlet channel or end piece, a robust form fit that enables a sliding of the slip joint can be realized in a simple manner. In particular, the aforementioned compression connection or friction connection between the contact surface and resting surface can be, preferably adjustably, realized in that the end piece or the end bushing is pressed against the casting mold with a fixing element. For this purpose, a, typically detachable, form-fitting and/or force-fitting connection between the end bushing and the fixing element can be provided.

A durable design can be achieved if the casting mold comprises a receptacle embodied as a recess in the casting mold, into which receptacle the end piece, possible the end bushing, is at least partially, in particular completely, inserted to produce the form fit. In particular, an undesired leakage of casting material between the end piece and outer casting mold surface can thus be efficiently prevented, or a potential risk thereof can be minimized. The respective injection opening of the casting mold, via which casting material can be injected into the cavity using the respective outlet nozzle, is normally arranged in a base surface of the receptacle. It is expedient if the resting surface on which the contact surface rests in a sliding manner is formed with a surface of the receptacle which limits the receptacle, for example the base surface or a wall surface. The end piece is thereby typically detachably inserted into the receptacles in a form fit.

For a high practicability, it is beneficial if a locking apparatus is present which prevents, in particular reversibly, a release of the sliding connection between the outlet channel and the casting mold, or of the form fit. For this purpose, the locking apparatus can expediently comprise a locking element that, in particular releasably, engages behind the form or the end bushing in order to produce the form fit. For a reliable fixing, it has proven effective if the locking element encloses an outer circumference of the outlet channel or the end piece thereof, in order to fix the form or end bushing in place. For this purpose, it is practicable if the locking element comprises a feed-through opening through which the outlet channel or the end piece thereof is guided, wherein the feed-through opening has an inner width or an inner diameter that is smaller than an outer width or an outer diameter of the outlet channel or the end bushing, in order to connect these in a form fit such that they are able to slide. A simple handling can be achieved if the form fit can be reversed by moving, in particular sliding or pivoting, the locking element relative to the casting mold, in order to detach the end piece or the end bushing from the casting mold. It is usually sufficient if a connection between the locking element and casting mold is realized with a screw connection or a similarly expedient releasable connection. It has proven effective if the receptacle can be at least partially locked using the locking apparatus, in order to fix, in particularly releasably, the end piece or the end bushing in place in a form fit in the receptacle, or to enclose it in the receptacle, such that it is able to slide. In particular, the aforementioned fixing element can expediently be formed with the locking element.

It is advantageous if a cooling apparatus is provided in order to cool the end bushing and/or the casting mold, in particular the receptacle. A sliding of the slip joint, in particular a sliding between the contact surface and resting surface, can thus be enabled independently of the operating status or casting material temperature. This is expedient for reproducibly ensuring a precise positioning or alignment of the outlet nozzles relative to the cavity or injection opening. In particular, a leakage of casting material between the outlet channel and casting mold, in particular along the contact surface, can thus be avoided by a solidification of leaking casting material. The cooling apparatus can be formed with one or more cooling channels through which a cooling medium can flow. These channels are thereby typically arranged in or inside of the end bushing or a wall forming the casting mold or receptacle. It is beneficial if the end bushing and the casting mold or receptacle can be cooled separately from one another, or if the end bushing or casting mold respectively comprise their own cooling apparatus, for example cooling channels that can be controlled separately from one another. However, it is often sufficient if the end bushing and casting mold are cooled by a shared cooling apparatus or one or more shared cooling channels.

It is beneficial if at least one temperature-control apparatus is present with which the outlet channels can be temperature-controlled, in particular heated or cooled. Thus, a casting material located in the outlet channels can be brought to an injection temperature, typically after or before an execution of an injection operation. It has proven effective if the outlet channels are temperature-controlled such that casting material located in the outlet channels is kept in a flowable state in order to be injected into the casting mold in a subsequent state. It is beneficial if casting material located in the outlet channels does not solidify or is kept flowable between two injection operations, in particular for an entire duration. The thermal expansions associated with a heating of the distributor unit or outlet channels over such an extended time, and the accompanying mechanical stress loads, can advantageously be compensated to a pronounced extent by the slip joint between the outlet channels and the casting mold. This applies in particular when thixotropic metal material or metal material in a thixotropic state is used as casting material. Said material is normally kept in a thixotropic state between two injection operations. The distributor unit or the outlet channels can expediently be embodied as a hot runner system in which casting material located in the distributor unit or the outlet channels between two injection operations or injection cycles is kept flowable. Typically, it is expediently provided that a plug is formed in the outlet nozzle after an injection operation by a solidification of casting material, which plug seals the outlet nozzle. In this manner, an outflow or after-flow of flowable casting material, in particular casting material kept flowable by heating, located downstream before the plug is efficiently prevented. It is expedient if the temperature-control apparatus is embodied as a heating device and/or cooling device. The temperature-control apparatus can be formed with one or more temperature-control channels through which a temperature-control means, for example a heating medium or cooling medium, can flow in order to temperature-control, in particular to heat or to cool, the outlet channels or the outlet nozzle. Alternatively or cumulatively, the temperature-control apparatus can be formed with one or more electric resistance heaters. It has proven especially effective, in particular alternatively or cumulatively, if the temperature-control apparatus is embodied with an electric induction heater, in order to heat casting material located in the outlet channels by means of electric induction. For an accurate temperature control, it is beneficial if multiple, in particular separately controllable, aforementioned temperature-control apparatuses are arranged along the outlet channels. It is particularly beneficial if a temperature control of the outlet nozzle and of an outlet channel segment or outlet channel segments of the outlet channel leading downstream to the outlet nozzle can be controlled separately from one another. As a result, in particular a plug formation in the outlet nozzle and a maintaining of a flowable state of an additional or remaining casting material in the outlet channel can be precisely controlled separately from one another. This can be practicably realized if the outlet nozzle and outlet nozzle segments can be temperature controlled with separate, in particular different, aforementioned temperature-control apparatuses. It has proven particularly effective if the outlet nozzle or casting material located therein can be heated using at least one induction heater. As a result, an injection operation and/or a plug formation after an injection operation can be controlled in a particularly precise manner. For this purpose, an electric induction heater, in particular multiple heaters of this type, can practicably be arranged, preferably such that it circumferentially encloses a channel run of the outlet nozzle, on the end piece or in the region of the outlet nozzle. For a flexible temperature control, it is beneficial if the outlet Channels, in particular outlet nozzles, can be temperature controlled separately from one another. For this purpose, multiple aforementioned temperature-control apparatuses that are typically arranged at different outlet channels or outlet nozzles can be present.

It shall be understood that aforementioned features which have been presented or described on the basis of or in reference to an outlet channel or the outlet nozzle thereof apply analogously to the envisaged other or additional outlet channels, or the outlet nozzles thereof, or are instead explicitly and preferentially provided.

It is typically provided that at least one of the outlet channels is formed with multiple longitudinal segments connected to one another or adjoining one another, the longitudinal axes of which are at an angle to one another in order to redirect casting material with the longitudinal segments. As a result, a redirection of the casting material can practicably take place with the distributor unit in order to apportion the casting material to multiple outlet channels. Normally, the longitudinal segments are thereby embodied such that they directly adjoin one another, though it is also possible that they adjoin one another indirectly, for example via intermediate elements. It is expedient if multiple, often all, outlet channels are embodied in such a manner. Here, it is beneficial if two adjoining longitudinal segments each have longitudinal axes that form an obtuse angle. A redirection of a casting material guided through the longitudinal segments can thus be kept small, and pressure drops and pressure peaks in the casting material, as well as force peaks in the longitudinal segments, can be avoided. In particular, it is beneficial if all longitudinal segments are embodied in such a manner.

To distribute the casting material, it is usually provided that different outlet channels are aligned, at least in sections, at an angle to one another. A design of this type is usually particularly susceptible to mechanical stresses as a result of thermal expansions, so that particularly pronounced relative movements between the outlet channels and outlet nozzles can arise, which, as presented above, can be greatly minimized by slip joints between the outlet channels and casting mold. It is beneficial if multiple, in particular all, outlet channels are aligned symmetrically, in particular rotationally symmetrically or mirror symmetrically, with a mirror axis. A loading or relative movement between the outlet channels can thus be reduced so that, in combination with the provided slip joint, an injection operation that can be carried out with particular precision is realizable with little mechanical loading.

The outlet channels are typically formed with pipes that are normally connected, such that they conduct casting material, to one or more shared inlet channels of the distributor unit. Expediently, the inlet channel can also be formed with a pipe. For a particularly robust design, it can be beneficial if the distributor unit is formed with a distributor body, wherein the distributor body comprises at least one inlet channel section and multiple outlet channel, sections connected thereto such that they conduct casting material, so that casting material conducted into the inlet channel section can be further conducted via the outlet channel sections. Normally, additional outlet channel pieces formed with pipes are then connected to the outlet channel sections, in order to further conduct to the casting mold casting material that is conducted via the outlet channel sections, in particular in the aforementioned manner. The distributor body can also comprise multiple inlet Channel sections connected to the outlet channel sections such that they conduct casting material. Because a branching of the casting material into multiple outlet channels takes place within the distributor body, mechanical stresses and thermal expansions can be distributed in a particularly uniform manner. Expediently, the distributor body can comprise one or more aforementioned temperature-control devices.

It is typically provided that different outlet channels, in particular if these are formed with pipes, are spaced apart from one another in a direction transverse to a longitudinal axis of the pipes. As a result, a sliding movement of the outlet channels or outlet nozzles relative to the casting mold can be carried out with particularly little reciprocal interference.

Normally, it is provided that the slip joint allows a movement of the outlet nozzle of several mm, typically at least 2 mm, usually at least 3 mm, often at least 4 mm, preferably at least 5 mm, relative to the casting mold in a direction transverse, in particular orthogonal, to the injection direction of the outlet nozzle. It shall be understood that, depending on the requirements, a movement of this type can also be at least 8 mm, at least 10 mm, or at least 15 mm. Normally, a relative movement between 2 mm and 15 mm, in particular between 3 mm and 10 mm, preferably approximately 5 mm, is thereby enabled.

The other object of the invention is attained with a method for creating at least one metal component of the type named at the outset if at least one of the outlet channels is connected to the casting mold in a sliding manner in order to enable a relative movement between the outlet nozzle of the outlet channel and the casting mold, in particular in a direction transverse to the injection direction of the outlet nozzle. Typically, at least one of the outlet channels is connected to the casting mold in a sliding manner by a slip joint, so that a relative movement between the outlet nozzle of said outlet channel and the casting mold is enabled to a limited extent in a direction transverse to the injection direction of the outlet nozzle. As a result, a relative movement between the outlet nozzles caused by thermal expansion of the distributor unit can be enabled. As explained above, a component can be produced in this manner with high process reliability and high component quality. In particular, a wear and a loading of the distributor unit can be reduced and an injection operation of the casting material into the cavity of the casting mold can be carried out with high, consistent quality. Accordingly, multiple or all of the outlet channels are advantageously connected to the casting mold in a sliding manner of this type.

It shall be understood that the method according to the invention can be embodied correspondingly or analogously to the features, advantages, and effects which are described, in particular described above, in the scope of an apparatus according to the invention. The same also applies to the apparatus according to the invention in respect of a described method according to the invention, in particular described below.

The casting material can be guided to one or more cavities of a casting mold with the outlet channels in order to produce one or more components. The outlet channels are typically realized as runners. It has proven especially beneficial if multiple outlet channels, in particular all outlet channels, guide casting material to a shared cavity. The cavity can thus be filled simultaneously via multiple outlet nozzles or injection openings, whereby an efficient filling of the cavity with few casting defects can be achieved. The cavity is thereby normally filled simultaneously using multiple outlet nozzles spaced apart from one another. If outlet nozzles are connected to the casting mold in a sliding manner, mechanical stresses acting on the outlet nozzles can be compensated by a sliding displacement of the outlet nozzles relative to the casting mold in a direction transverse or angular, in particular orthogonal, to the injection direction.

It is preferably provided that the outlet channels are heated after injection of the casting material, in order to prevent a total or complete solidification of casting material located in the outlet channels, or to keep a casting material located in the outlet channels flowable, in particular in a fluid state. Normally, it is thereby merely provided that a plug formed with solidified casting material is formed, but casting material positioned downstream before the plug is kept flowable in the outlet channels by heating, in order to prevent a total solidification of casting material located in the outlet channels. This can occur, as described above, with a temperature-control apparatus, in particular a heating device, in order to heat the casting material. It is often provided that a casting material located in the outlet nozzle solidifies or is solidified in order to form a plug that prevents a leakage of a flowable casting material positioned downstream before the plug in the outlet channel. A flowable casting material positioned before the plug in the outlet channel is thereby normally heated in order to prevent solidification thereof until the next injection operation or until the creation of the next component. The chronologically prolonged temperature loading associated with the heated casting material and accompanying thermal expansion of the distributor unit or outlet channels can be extensively compensated by the sliding connection between the at least one outlet channel and the casting mold.

A particularly high casting precision can be achieved if a sliding movement of the outlet nozzle relative to the casting mold is carried out such that an outlet opening of the outlet nozzle of the outlet channel and an injection opening of the casting mold are aligned to be flush with one another when the outlet channel is at casting temperature, in order to inject casting material into the cavity through the outlet opening via the injection opening. The sliding movement thereby typically occurs as caused by thermal expansion of the distributor unit, in particular of the outlet channel, or during a heating of the distributor unit or the outlet channel. Here, it is expedient if the at least one outlet nozzle is aligned relative to an injection opening of the casting mold, via which injection opening casting material is injected into the cavity using the outlet nozzle when the distributor unit or outlet channel is at casting temperature, such that a sliding movement of the outlet nozzle relative to the casting mold is carried out so that a flush or centered position between an outlet opening of the outlet nozzle and the injection opening is assumed at the casting temperature. Normally, the at least one outlet nozzle is aligned relative to the injection opening of the casting mold such that the outlet opening of the outlet nozzle is off-center from the injection opening at non-casting temperature, in particular room temperature, and is or has been displaced into a flush or centered or concentric position by sliding at casting temperature, at which casting material can be injected into the casting mold and to which the outlet channels are heated. Depending on the casting material, the casting temperature is normally several hundred ° C., often approximately 600° C., for example in the case of a casting material filmed with a magnesium alloy. The relative displacement between the outlet channel and casting mold associated with a thermal expansion is normally several mm. Because the outlet nozzle is adjusted such that it is displaced to a corresponding degree, an optimal flush or centered alignment can be achieved at casting temperature.

Additional features, advantages, and effects follow from the exemplary embodiments described below. In the drawings which are thereby referenced:

Figure 1:
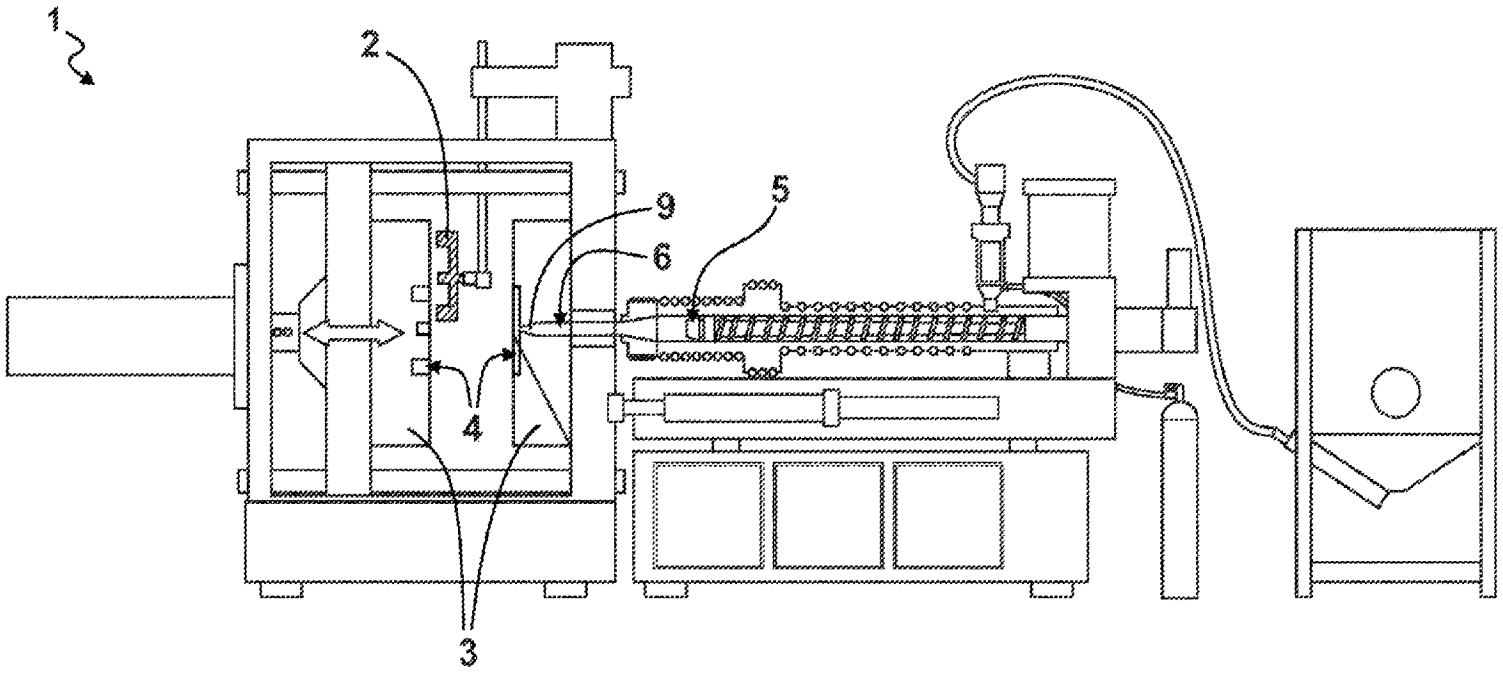
FIG. 1 shows a schematic illustration of an apparatus for producing a metal component with a thixomolding method.

FIG. 1 shows a schematic illustration of a typical apparatus 1 for producing a metal component 2 by injecting flowable, in particular thixotropic, metal casting material into a cavity 4 of a multi-part casting mold 3. An apparatus 1 of this type typically comprises a filling chamber, also referred to as a barrel, a conveying unit, often embodied as a screw conveyor, a distributor arranged downstream after the filling Chamber, via which distributor unit casting material is conveyed from the conveying device 5, formed with the filling chamber and conveying unit, to the casting mold 3 under pressure in order to inject the casting material into the cavity 4 of the casting mold 3, and the casting mold 3 arranged after the distributor unit 6. The distributor unit 6 comprises at least one inlet channel 7, which is connected to the conveying device, and multiple outlet channels 8, which are connected to the casting mold 3, in order to fill the cavity 4 of the casting mold 3 with casting material in a chronologically parallel manner via the outlet channels 8. For this purpose, each outlet channel 8 comprises one outlet nozzle 9 with which casting material can be injected into the cavity 4 via one injection opening 10 of the form 3 each that corresponds to the respective outlet nozzle 9. A distributor unit of this type is, for example, schematically illustrated in FIG. 2 or FIG. 3.

As can be seen in FIG. 1, the multi-part casting mold 3 is normally formed with an immovable first plate and a second plate that is movable relative to the first plate. Surfaces of the first plate and/or second plate have a negative shape of the component 2 that is to be created. By placing the first plate and second plate together, the mold is closed and a cavity 4 corresponding to the component 2 is formed. The outlet nozzles 9 typically connect to the first plate, so that casting material can be injected into the cavity 4 via an outlet nozzle opening of the respective outlet nozzle 9. In the case of a processing of thixotropic casting material, the filling chamber normally comprises a heater with which the casting material is brought into a thixotropic state, typically with simultaneous shearing of the casting material using the screw conveyor. A subsequent injection of the material into the cavity 4 of the casting mold 3 via the outlet nozzles 9 normally occurs through an axial forward movement of the screw conveyor in the direction of the distributor unit 6 or outlet nozzles 9.

FIG. 1 shows a method state after a solidifying of the component 2 in the casting mold 3. Particularly in a processing of casting material in a thixotropic state, plugs of solidified casting material are thereby normally formed in the outlet nozzles 9, in order to hinder a flowable casting material positioned downstream before the plug from leaking out of the outlet nozzles 9. In FIG. 1, the casting mold 3 is open, wherein the created component 2 is removed from the casting mold 3 using a robot arm. In a next production cycle, during an injection of casting material into the mold to produce a next component 2, a respective plug of this type is typically also pressed into the cavity 4 or ejected.

Figure 2:
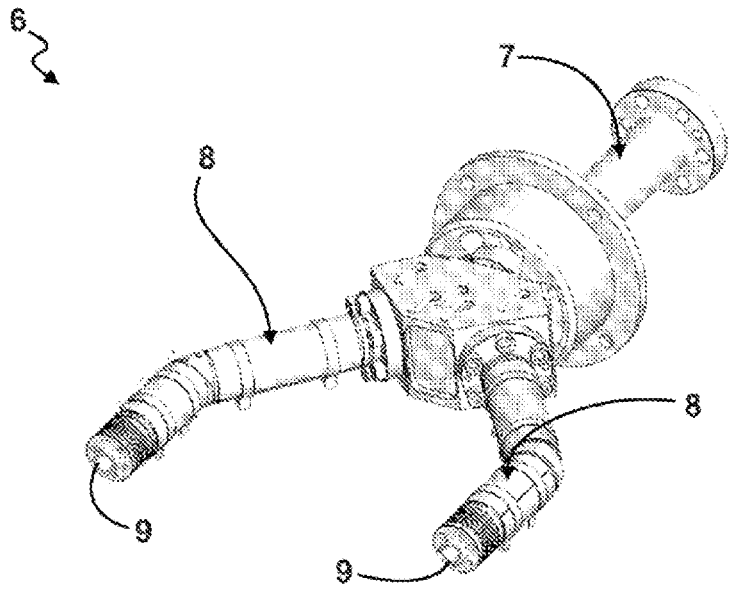
FIG. 2 shows a schematic spatial illustration of a distributor unit.
Figure 3:
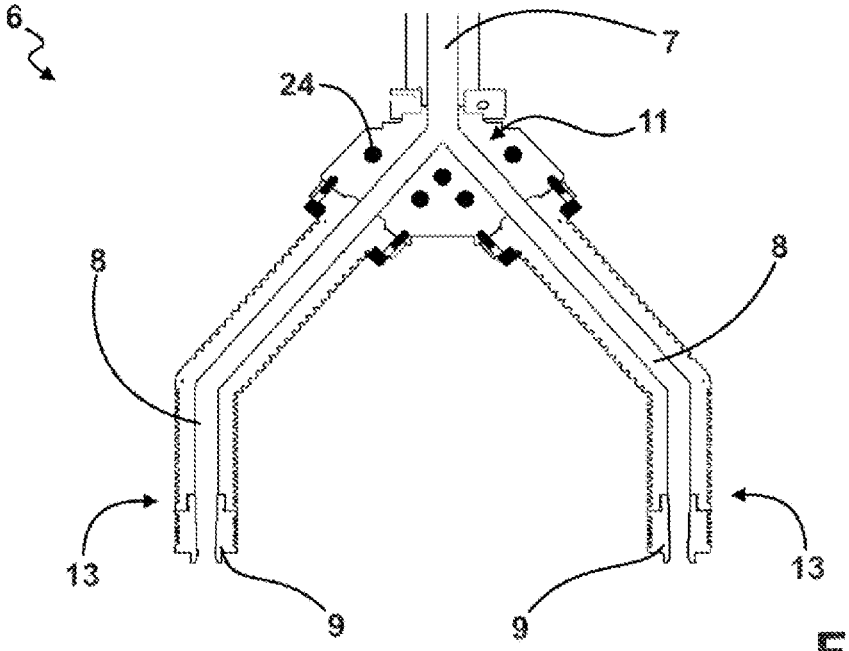
FIG. 3 shows a schematic illustration of a distributor unit in a longitudinal section through the distributor unit.

FIG. 2 and FIG. 3 show schematic illustrations of a distributor unit 6, as it can be used, for example, in an apparatus 1 from FIG. 1. The distributor unit 6 comprises an inlet channel 7 and two outlet channels 8 in order to feed casting material fed via the inlet channel 7 to the casting mold 3 via the outlet channels 8. The outlet channels 8 each comprise one outlet nozzle 9 via which casting material can be injected into the cavity 4. The outlet channels 8 are formed with pipes that are connected to the inlet channel 7 such that they conduct casting material. Different outlet channels 8 are thereby normally spaced apart from one another in a direction transverse to a longitudinal axis of the outlet channels 8, in order to minimize a reciprocal interference, for example due to occurring mechanical forces and/or thermal expansions. To achieve a high robustness, the distributor unit 6 can be formed with a distributor body 11, comprising an inlet channel section and two outlet channel sections, in order to apportion to the outlet channel sections casting material fed via the inlet channel section. The inlet channel section and the outlet channel sections are typically connected to one another at a shared junction such that they conduct casting material. Outlet channel parts formed with pipes typically connect to the outlet channel sections in order to further conduct casting material to the casting mold 3. Expediently, the distributor body 11 can comprise one or more heating devices 24.

In order to avoid mechanical stresses up to deformations or buckling of the outlet channels 8, the outlet channels 8 are respectively connected to the casting mold 3 in a sliding manner by a slip joint in order to enable a relative movement between the respective outlet nozzle 9 and the casting mold 3 in a direction transverse to the longitudinal axis of the outlet channels 8 or injection direction of the outlet nozzle 9. In this manner, mechanical stresses caused by thermal expansion can be eliminated in the form of a relative movement between the outlet nozzles 9 or outlet channels 8.

Figure 4:
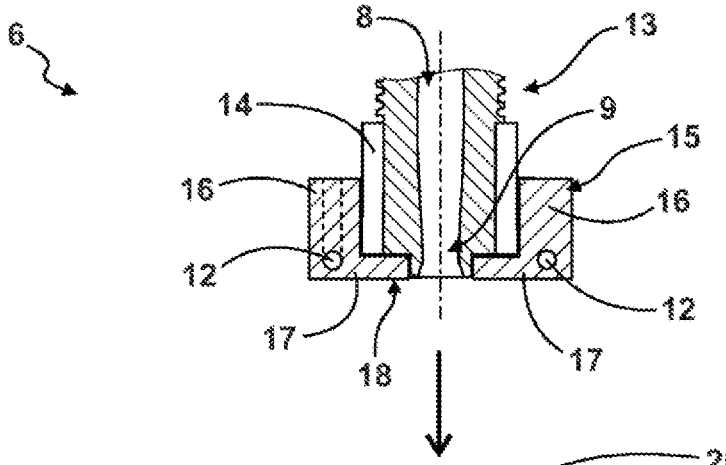
FIG. 4 shows a schematic illustration of an end piece of an outlet channel with an end bushing.

FIG. 4 shows an end piece 13 of an outlet channel 8, comprising an outlet nozzle 9. Expediently, the outlet channels 8 from FIG. 1 through FIG. 3 can be embodied in this manner. The end piece 13 comprises a temperature-control apparatus which is preferably embodied as an induction heater 14, in order to temperature-control, in particular to heat, casting material located in the outlet nozzle 9. The end piece 13 of the outlet channel 8 is inserted into an end bushing 15 which envelops a circumference of the outlet channel 8 in a form fit with a first end bushing section 16 and grips a side of the outlet channel 8 facing the casting mold 3 with a second end bushing section 17. The first end bushing section 16 effects an enlargement of an outer diameter of the end piece 13 in order to connect the end piece 13 to the casting mold 3 in a form fit. The second end bushing section 17 forms a contact surface 18 in order to set said surface, in a sliding manner, on a resting surface 19 corresponding to the contact surface 18. The end bushing 15 can expediently be embodied with a shape of a cup, wherein a cup bottom of the cup comprises a passage into which the outlet nozzle 9 opens, or through which the outlet nozzle 9 is at least partially guided. As can be seen in FIG. 4, it is beneficial if the end hushing 15 is cooled with a cooling apparatus, for example cooling channels 12.

Figure 5:
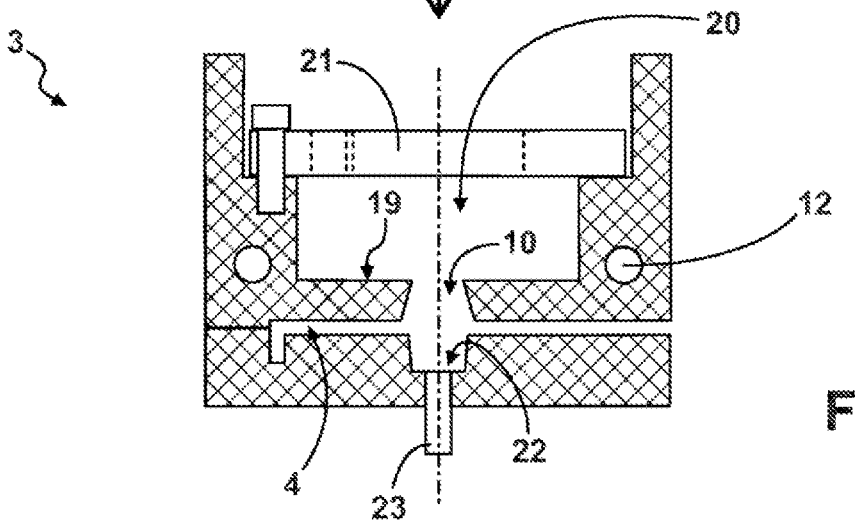
FIG. 5 shows a schematic illustration of a casting mold with a receptacle corresponding to the end piece from FIG. 4, into which receptacle the end piece can be inserted to form a slip joint.

FIG. 5 shows a schematic illustration of a segment of a casting mold 3, for example a casting mold 3 according to FIG. 1. The casting mold 3 comprises a receptacle 20 corresponding to the end piece 13 from FIG. 4, into which receptacle 20 the end piece 13 or the end bushing 15 can be inserted to form a slip joint. The receptacle 20 is typically embodied as a recess in the casting mold 3, wherein an injection opening 10 of the casting mold 3, via which injection opening 10 casting material can be injected into the cavity 4 using the outlet nozzle 9, is arranged in a base surface of the receptacle 20. The casting mold 3, or the receptacle 20 thereof, comprises a locking apparatus 21 with which the receptacle 20 can be locked such that an end bushing 15 inserted into the receptacle 20 is enclosed in the receptacle 20 in a form fit, so that a sliding movement of the end bushing 15 in the receptacle 20 is enabled transversely, in particularly orthogonally, to the injection direction of the outlet nozzle 9 of the end piece 13. The locking apparatus 21 can expediently be releasably connected to a part of the casting mold 3 by a screw connection. Further visible in FIG. 5 is a plug receptacle 22, which is embodied as part of the cavity 4 opposite of the injection opening 10, in order to receive a plug ejected from the outlet nozzle 9 during an injection of casting material into the casting mold 3. Typically, the casting mold 3 comprises an ejector unit 23 with which a component 2 solidified in the cavity 4 can be pushed out of the cavity 4 by displacement of the ejector unit 23. The casting mold 3 normally comprises one or more cooling apparatuses, usually in the form of cooling channels 12, in order to cool the casting mold 3. Preferably, the casting mold 3 and the end bushing 15 comprise cooling channels 12 that can be controlled separately from one another, or each comprise their own cooling apparatus.

Figure 6:
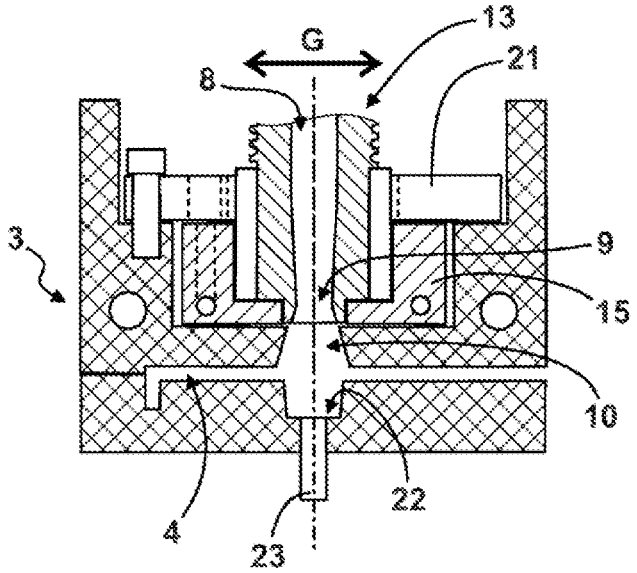
FIG. 6 shows a schematic illustration of the end piece from FIG. 4 in an inserted state in the receptacle from FIG. 5.

FIG. 6 shows a schematic illustration of the end piece 13 of the outlet channel 8 from FIG. 4, which outlet channel 8 is inserted into the receptacles 20 from FIG. 5 in a form fit, so that a sliding movement of the end piece 13 is enabled in one or more movement directions G transverse to the injection direction of the outlet nozzle 9 of the end piece 13. An outlet opening of the outlet nozzle 9 is thereby aligned such that it is centered with the injection opening 10 of the casting mold 3 in order to inject casting material into the cavity 4 via the outlet nozzle 9.

Preferably, the casting mold 3 comprises multiple receptacles 20 of this type, in order to respectively insert an end piece 13 or an end bushing 15 of one of the outlet channels 8 thereinto in a form fit, so that the respective end piece 13 can be moved in a sliding manner in a direction transverse to the injection direction of the respective outlet nozzle 9. Preferably, each of the outlet channels 8 is connected thusly to the casting mold 3 in a sliding manner.

Because at least one of the outlet channels 8, typically all outlet channels 3, are connected to the casting mold 3 in a sliding manner so that the respective outlet nozzle 9 can be moved relative to the casting mold 3 in a direction transverse to the injection direction of the nozzle, thermal expansions of the distributor unit 6 or the outlet channels 8 occurring during operation can be compensated. Impairments of an injection operation can thus be minimized or prevented, whereby a metal component 2 can be produced with high process reliability and with high quality.

The invention claimed is:

1. An apparatus for creating at least one metal component by injecting flowable metal casting material into at least one cavity of a multi-part casting mold, comprising, arranged successively downstream, a conveyor device for the flowable metal material, a distributor unit and the multi-part casting mold, wherein the distributor unit comprises an inlet channel, which is connected to the conveyor device, and multiple outlet channels each having an outlet nozzle, such that casting material fed under pressure via the distributor inlet channel can be injected via the outlet nozzles into the at least one cavity of the casting mold in order to simultaneously fill the at least one cavity with casting material via the outlet nozzles, wherein at least one of the outlet channels is connected to the casting mold in a sliding manner in order to enable a relative movement between the outlet nozzle of the outlet channel and the casting mold, and wherein the outlet channel is connected to the casting mold in a sliding manner so that the outlet nozzle of the outlet channel can be displaced transversely to an injection direction of the outlet nozzle relative to the casting mold.

2. The apparatus according to claim 1, wherein, when the outlet channel is at casting temperature, an outlet opening of the outlet nozzle of the outlet channel and an injection opening of the casting mold are aligned to be essentially flush with one another by a sliding movement of the outlet nozzle relative to the casting mold in order to inject casting material into the cavity through the outlet opening via the injection opening.

3. The apparatus according to claim 1, wherein the outlet channel and the casting mold are connected to one another in a sliding manner in a form fit, wherein a relative movement between the outlet nozzle of the outlet channel and the casting mold is enabled to a limited extent in a direction transverse to the injection direction of the outlet nozzle.

4. The apparatus according to claim 3, wherein the outlet channel has an outer diameter that varies along its longitudinal axis in order to create the form fit between the outlet channel and the casting mold.

5. The apparatus according to claim 3, wherein the outlet channel comprises a form in a ring shape, in order to create the form fit between the outlet channel and the casting mold.

6. The apparatus according to claim 5, wherein the form of the outlet channel runs along a circumference of the outlet channel.

7. The apparatus according to claim 1, wherein the end piece of the outlet channel is inserted into an end bushing, wherein the end bushing constitutes an enlargement of an outer diameter of the outlet channel (8) in order to connect the outlet channel to the casting mold in a sliding manner.

8. The apparatus according to claim 7, wherein the end bushing is a detachable end bushing.

9. The apparatus according to claim 1, wherein a contact surface is arranged on an end piece of the outlet channel that comprises the outlet nozzle, which contact surface rests in a sliding manner on a resting surface of the casting mold that corresponds to the contact surface in order to connect the outlet channel to the casting mold in a sliding manner.

10. The apparatus according to claim 9, wherein the contact surface is flat.

11. The apparatus according to claim 1, wherein the casting mold comprises a receptacle embodied as a recess in the casting mold, into which receptacle the end piece is inserted for the sliding connection of the outlet channel to the casting mold.

12. The apparatus according to claim 1, wherein a locking apparatus is present which prevents a release of the sliding connection between the outlet channel and the casting mold.

13. The apparatus according to claim 12, wherein the presence of the locking apparatus prevents, reversibly, a release of the sliding connection between the outlet channel and casting mold.

14. The apparatus according to claim 1, wherein at least one temperature-control apparatus is present with which the outlet channels can be temperature controlled.

15. The apparatus according to claim 14, wherein the presence of the at least one temperature-control apparatus temperature controls the nozzles of the outlet channels.

16. The apparatus according to claim 1, wherein at least one of the outlet channels is formed with multiple longitudinal segments adjoining one another, the longitudinal axes of which are at an angle to one another.

17. The apparatus according to claim 1, wherein the flowable metal material is a thixotropic metal material.

18. The apparatus according to claim 1, wherein the distributor unit is embodied as a hot runner system.

19. A method for creating at least one metal component using an apparatus according to claim 1, wherein flowable metal casting material is guided, under pressure, from a conveyor device to a multi-part casting mold via a distributor unit to create the metal component, wherein the casting material is guided to multiple outlet channels of the distributor unit via at least one inlet channel of the distributor unit and is injected into at least one cavity of the casting mold via outlet nozzles of the outlet channels in order to simultaneously fill the at least one cavity with casting material via the outlet nozzles, wherein at least one of the outlet channels is connected to the casting mold in a sliding manner in order to enable a relative movement between the outlet nozzle of the outlet channel and the casting mold.

20. The method according to claim 19, wherein the outlet channels are heated following injection of the casting material in order to prevent a total solidification of casting material located in the outlet channels.

21. The method according to claim 19, wherein a sliding movement of the outlet nozzle relative to the casting mold is carried out, so that an outlet opening of the outlet nozzle of the outlet channel and an injection opening of the casting mold are aligned to be essentially flush with one another when the outlet channel is at casting temperature, in order to inject casting material into the cavity through the outlet opening via the injection opening.

* * * * *